US008886064B2

(12) United States Patent
Fujimoto

(10) Patent No.: US 8,886,064 B2
(45) Date of Patent: Nov. 11, 2014

(54) FIXING DEVICE, HEATER CONTROL METHOD, AND IMAGE FORMING APPARATUS INCORPORATING SAME

(75) Inventor: Ippei Fujimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 274 days.

(21) Appl. No.: 13/446,100

(22) Filed: Apr. 13, 2012

(65) Prior Publication Data

US 2012/0301161 A1 Nov. 29, 2012

(30) Foreign Application Priority Data

May 25, 2011 (JP) ..... 2011-117439

(51) Int. Cl.
*G03G 15/20* (2006.01)

(52) U.S. Cl.
CPC ..... *G03G 15/205* (2013.01); *G03G 2215/2035* (2013.01)
USPC ..... 399/33; 399/70

(58) Field of Classification Search
CPC ..... G03G 15/2039; G03G 15/2078
USPC ..... 399/33, 70
See application file for complete search history.

(56) References Cited

U.S. PATENT DOCUMENTS

| | | | | |
|---|---|---|---|---|
| 6,101,346 | A * | 8/2000 | Arakawa | 399/70 |
| 6,393,230 | B1 * | 5/2002 | Haneda et al. | 399/69 |
| 7,190,911 | B2 * | 3/2007 | Sato et al. | 399/8 |
| 7,248,807 | B2 * | 7/2007 | Oka et al. | 399/33 |
| 7,457,551 | B2 * | 11/2008 | Shishikura | 399/44 |
| 7,509,085 | B2 | 3/2009 | Yoshinaga et al. | |
| 7,546,049 | B2 | 6/2009 | Ehara et al. | |
| 7,840,151 | B2 | 11/2010 | Fujimoto | |
| 7,912,392 | B2 | 3/2011 | Yoshinaga et al. | |
| 8,073,352 | B2 | 12/2011 | Kunii et al. | |
| 2010/0290796 | A1 * | 11/2010 | Sato | 399/33 |
| 2010/0290822 | A1 | 11/2010 | Hasegawa et al. | |

(Continued)

FOREIGN PATENT DOCUMENTS

| | | |
|---|---|---|
| JP | 6-131061 | 5/1994 |
| JP | 2005-92080 | 4/2005 |

OTHER PUBLICATIONS

U.S. Appl. No. 13/293,794, filed Nov. 10, 2011, Masaaki Yoshikawa, et al.

(Continued)

*Primary Examiner* — Walter L Lindsay, Jr.
*Assistant Examiner* — Philip Marcus T Fadul
(74) *Attorney, Agent, or Firm* — Oblon, Spivak, McClelland, Maier & Neustadt, L.L.P.

(57) ABSTRACT

A fixing device includes a rotary, endless fuser belt, a heater, a thermometer, and a controller. The fuser belt is subjected to heating, on which the recording medium is conveyed to fuse the toner image thereon. The heater is located adjacent to the fuser belt for heating the belt. The thermometer is located adjacent to the fuser belt to detect an operational temperature of the belt. The controller is operatively connected to the thermometer and the heater to deactivate the heater upon detecting an abnormal condition in which the operational temperature detected remains below a setpoint temperature after lapse of a warm-up time limit since activation of the heater. The controller includes a historical data recorder and a processor. The historical data recorder records historical usage data of the fixing device since installation. The processor adjusts the warm-up time limit according to the historical usage data recorded.

17 Claims, 6 Drawing Sheets

(56) References Cited

U.S. PATENT DOCUMENTS

| | | | | |
|---|---|---|---|---|
| 2011/0026988 | A1 | 2/2011 | Yoshikawa et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064443 | A1 | 3/2011 | Iwaya et al. | |
| 2011/0076071 | A1 | 3/2011 | Yamaguchi et al. | |
| 2011/0085832 | A1 | 4/2011 | Hasegawa et al. | |
| 2011/0097663 | A1* | 4/2011 | Campbell et al. | 430/124.1 |
| 2011/0116848 | A1 | 5/2011 | Yamaguchi et al. | |
| 2011/0129268 | A1 | 6/2011 | Ishii et al. | |
| 2011/0170917 | A1 | 7/2011 | Yoshikawa et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0274453 | A1 | 11/2011 | Shimokawa et al. | |
| 2012/0051774 | A1 | 3/2012 | Ikebuchi et al. | |
| 2012/0243896 | A1* | 9/2012 | Otsuka et al. | 399/70 |

OTHER PUBLICATIONS

U.S. Appl. No. 13/293,561, filed Nov. 10, 2011, Tetsuo Tokuda, et al.
U.S. Appl. No. 13/286,796, filed Nov. 1, 2011, Ippei Fujimoto, et al.
U.S. Appl. No. 13/291,678, filed Nov. 8, 2011, Hiromasa Takagi, et al.
U.S. Appl. No. 13/345,934, filed Jan. 9, 2012.
U.S. Appl. No. 13/311,002, filed Dec. 5, 2011, Yoshiki Yamaguchi, et al.
U.S. Appl. No. 13/326,847, filed Dec. 15, 2011, Toshihiko Shimokawa, et al.
U.S. Appl. No. 13/343,468, filed Jan. 4, 2012.
U.S. Appl. No. 13/346,093, filed Jan. 9, 2012.
U.S. Appl. No. 13/315,704, filed Dec. 9, 2011, Yoshiki Yamaguchi, et al.
U.S. Appl. No. 13/413,034, filed Mar. 6, 2012.
U.S. Appl. No. 13/410,821, filed Mar. 2, 2012.
U.S. Appl. No. 13/315,581, filed Dec. 9, 2011, Masaaki Yoshikawa, et al.

* cited by examiner

FIXING DEVICE, HEATER CONTROL METHOD, AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-117439, filed on May 25, 2011, the entire disclosure of which is hereby incorporated by reference herein.

BACKGROUND OF THE INVENTION

1. Technical Field

The present invention relates to a fixing device, a heater control method, and an image forming apparatus incorporating the same, and more particularly, to a fixing device that fixes a toner image in place on a recording medium with a heated, endless fuser belt, a heater control method for use in the fixing device, and an electrophotographic image forming apparatus, such as a photocopier, facsimile machine, printer, plotter, or multifunctional machine incorporating several of these features, that incorporates the fixing device.

2. Background Art

In electrophotographic image forming apparatuses, such as photocopiers, facsimile machines, printers, plotters, or multifunctional machines incorporating several of these features, an image is formed by attracting developer or toner particles to a photoconductive surface for subsequent transfer to a recording medium such as a sheet of paper. After transfer, the imaging process may be followed by a fixing process using a fixing device, which permanently fixes the toner image in place on the recording medium with heat and pressure.

In general, a fixing device includes a pair of generally cylindrical looped belts or rollers, one being heated for fusing toner ("fuser member") and the other being pressed against the heated one ("pressure member"), which together form a heated area of contact called a fixing nip. As a recording medium bearing a toner image thereupon enters the fixing nip, the fuser member heats the recording medium to fuse and melt the toner particles, while the pressure member presses the recording medium against the fuser member to fix the molten toner onto the recording medium.

Modern fixing processes used in power-saving printers are designed with low power consumption. For example, some fixing devices save power consumed in heating a fuser member by activating an electronic heater only where necessary to execute printing, that is, starting power supply to the heater only after receiving a print request, and otherwise leaving the heater deactivated.

One important aspect of such a fixing device is the capability to reduce a period of warm-up time required for to heat the fuser member to a setpoint temperature upon activation. For power-saving applications, a long warm-up time is usually undesirable, since it means a prolonged period of inertia during which the printer cannot perform printing, resulting in a correspondingly long period of first-print time between reception and completion of a first print request submitted upon power-on of the printer.

In an effort to provide a fixing process with shorter warm-up and first-print times, a belt-based fixing device has been proposed based on an endless fuser belt that exhibits a lower heat capacity compared to that of a cylindrical roller. This fixing device includes a pair of opposed rotary members, one being a fuser belt looped into a generally cylindrical configuration, and the other being a generally cylindrical, rotatable pressure member, pressed against each other to form a fixing nip therebetween, through which a recording medium is conveyed under heat and pressure as the rotary fixing members rotate together.

The fuser belt assembly has a radiant, halogen heater disposed inside the belt loop for directly radiating heat. Also, the fuser belt is provided with a black coating material deposited on the belt inner circumferential surface for promoting generation of radiant heat in the belt. According to this method, direct radiation with the halogen heater, which accelerate heating of the belt, in conjunction with provision of the black coating, which increases thermal efficiency in radiant heating, results in a short warm-up time, such as, for example, of 10 seconds or even shorter in the fixing device.

To date, several fixing processes are known provided with a capability to detect an abnormal condition, that is, a possible anomaly of a heating control system in which a thermometer fails to correctly measure an operational temperature of a fuser member, and/or a heater and its power supply do not function properly to heat a fuser member to a desired setpoint temperature.

For example, a belt-based fixing device is known employing an endless fuser belt equipped with a halogen lamp as well as a thermometer, which incorporates an overheat detection capability to detect an abnormal condition where an operational temperature detected by the thermometer exceeds a maximum threshold temperature, indicating overheating of the fuser belt.

Another fixing device is known that employs a cylindrical fuser roller, instead of a fuser belt, equipped with a heater as well as a thermometer, which incorporates an underheat detection capability to detect an abnormal condition where an operational temperature detected by the thermometer does not reach a minimum threshold temperature upon lapse of a warm-up time limit since activation of the heater, indicating underheating of the fuser belt or misdetection of the thermometer.

Upon detecting an abnormal condition, these fixing devices may deactivate the heater and stop conveyance of recording media, thereby suspending execution of a current print job, while notifying a user of printing failure by displaying an alert message on a control panel which prompts a user to call a customer service number.

The inventor has recognized difficulties associated with anomaly detection in a belt-based fixing device, which arise from aging or other temporal changes in operational conditions of the fuser belt assembly, causing variations in the speed or efficiency with which the heater heats the fuser belt to a desired, setpoint temperature.

Specifically, the heating speed of the fuser belt may decrease over time because of various factors caused by an extended period of use of the fixing device. For example, one such factor is aging of the belt heater, which leads to a natural reduction in heating performance. Another such factor is gradual deposition of foreign matter on the belt heater (e.g., grease or lubricant agent migrating from the belt inner circumferential surface to the heater), which can adversely affect electromagnetic radiation, in particular, where the heater is configured as a radiant, halogen heater.

Still another factor occurs where the fixing device uses a reflector or reflective surface that directs electromagnetic radiation from the heater to the fuser belt for increasing thermal efficiency. As is the case with the belt heater, gradual deposition of foreign matter on the reflector adversely affects electromagnetic reflection, resulting in a concomitant reduction in the radiant heat generated in the fuser belt.

Yet still another factor occurs where the fuser belt is provided with a black coating material on its inner circumferential surface for increasing thermal efficiency. In this case, abrasion on the belt surface due to sliding against an adjoining element, such as a fuser pad, results in thinning of the black coating and smoothening of the belt surface, both of which adversely affect electromagnetic absorption in the fuser belt, resulting in a concomitant reduction in the radiant heat generated in the fuser belt.

Reduced thermal efficiency and decelerated heating of the fuser belt translates into a prolonged period of time required for the belt temperature to reach a setpoint temperature upon activation of the heater. Accordingly, as the fuser belt assembly ages or is more used, a warm-up time limit for anomaly detection, designed to work with the fixing device in its new, unaged state, becomes less effective, since prematurely expires before the belt temperature reaches the setpoint even where the heating control system is properly operating. If not corrected, premature expiration of the warm-up time limit causes the anomaly detector to mistakenly detect an abnormal condition that actually does not exist.

To counteract the problem, one possible measure is to establish a sufficiently long warm-up time limit that does not expire prematurely insofar as its heating control system properly operates regardless of whether the fixing device is in its unaged state or aged state.

Unfortunately, however, such a measure is not practical or even effective, because setting a long warm-up time limit in a newly installed fixing device would in turn hinder correct and immediate anomaly detection in response to occurrence of an abnormal condition, leading to various adverse consequences.

For example, failure to timely detect an anomaly may cause a delay in submitting a notification of printing failure to allow a user to reallocate the failed print job to an alternative printer, resulting in a significant delay in providing a printed output, which detracts from user convenience and utility of the printer. Also, delayed anomaly detection can cause a delay in repair or servicing the fixing device for correcting an abnormal condition detected, resulting in a prolonged downtime of the printer. Further, delayed anomaly detection can damage the fuser belt where the anomaly detector ignores a thermometer failure to correctly detect a fuser belt temperature, in which case the heater does not stop heating even where the belt temperature exceeds a setpoint temperature, resulting in overheat and concomitant thermal damage to the fuser belt.

SUMMARY OF THE INVENTION

Exemplary aspects of the present invention are put forward in view of the above-described circumstances, and provide a novel fixing device for fixing a toner image in place on a recording medium.

In one exemplary embodiment, the fixing device includes a rotary, endless fuser belt, a heater, a thermometer, and a controller. The fuser belt is subjected to heating, on which the recording medium is conveyed to fuse the toner image thereon. The heater is located adjacent to the fuser belt for heating the belt. The thermometer is located adjacent to the fuser belt to detect an operational temperature of the belt. The controller is operatively connected to the thermometer and the heater to deactivate the heater upon detecting an abnormal condition in which the operational temperature detected remains below a setpoint temperature after lapse of a warm-up time limit since activation of the heater. The controller includes a historical data recorder and a processor. The historical data recorder records historical usage data of the fixing device since installation. The processor adjusts the warm-up time limit according to the historical usage data recorded by the historical data recorder.

Other exemplary aspects of the present invention are put forward in view of the above-described circumstances, and provide a heater control method for use in a fixing device that employs a heater to heat a rotary, endless belt.

In one exemplary embodiment, the method includes the steps of activation, detection, adjustment, and deactivation. The activation step activates the heater. The detection step detects an operational temperature of the belt. The adjustment step adjusts a warm-up time limit according to historical usage data of the fixing device recorded since installation. The deactivation step deactivates the heater where the operational temperature detected remains below a setpoint temperature after lapse of the warm-up time limit since activation of the heater.

Still other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
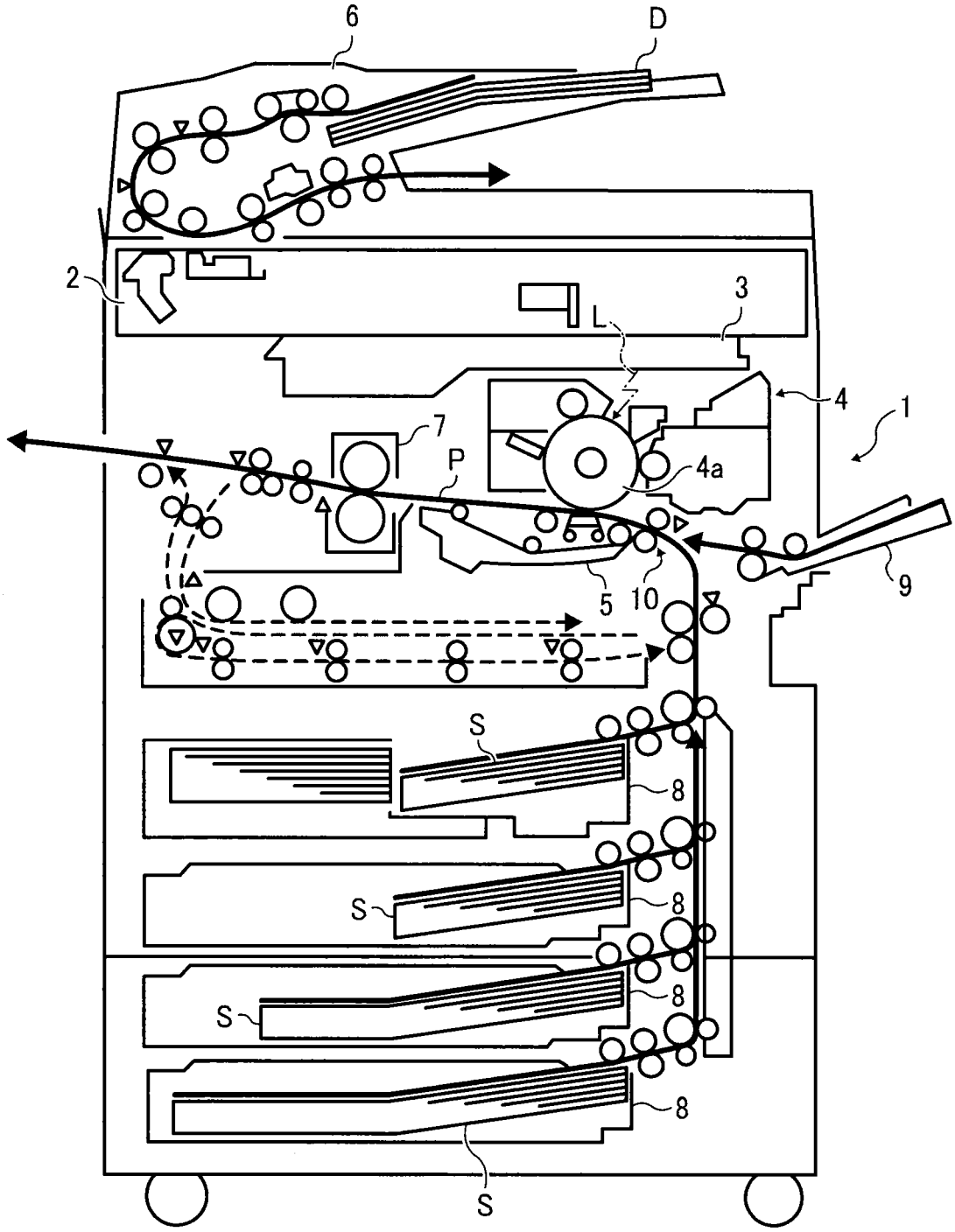
FIG. 1 schematically illustrates an image forming apparatus incorporating a fixing device according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 7 according to one or more embodiments of this patent specification.

As shown in FIG. 1, the image forming apparatus 1 in the present embodiment comprises an electrophotographic photocopier including an image scanner 2 for generating digital image data based on analog information optically captured from an original document D; an exposure device 3 that generates a beam of light L, such as a laser beam, according to image data output from the image scanner 2 or that transmitted from an external data source, such as a personal computer (PC); an imaging unit 4 including a drum-shaped photoconductor 4*a* which is exposed to the laser beam L to create an electrostatic latent image thereon for subsequent development using toner; a transfer unit 5 for transferring the toner image from the photoconductive surface to a recording medium such as a sheet of paper S.

Also included in the image forming apparatus 1 are an automatic document feeder 6 located above the image scanner 2 for automatically feeding a user-input document D for optical scanning; one or more input trays 8 each accommodating a stack of recording sheets S; a manual input tray 9 for allowing a user to manually input a recording sheet S; and a pair of registration rollers 10 and various conveyor members, such as guide plates and rollers, which together define a sheet conveyance path P along which the recording sheet S is conveyed from the input tray, through the registration roller pair 10 to the transfer unit 5, and then to the fixing device 7.

Located along the media conveyance path P, the fixing device 7 includes a belt-based fuser assembly that employs a rotary, endless fuser belt subjected to heating for fusing a toner image on a recording medium. Specific configurations of the fixing device 7 and its associated structure will be described in more detail with reference to FIG. 2 and subsequent drawings.

During operation, to reproduce a copy of a user-input document D, the automatic document feeder 6 automatically feeds the original document D downward toward the image scanner 2, with its image side down facing the scanning element. As the document D proceeds, the image scanner 2 scans the surface of the document D to obtain image information, which is converted into electrical data signals for subsequent transmission to the exposure device 3. The exposure device 3 then irradiates the surface of the photoconductor 4*a* with a light beam L from a laser diode modulated according to the image data signals.

In the imaging unit 4, the photoconductive drum 4*a* rotates in a given rotational direction (clockwise in the drawing) to undergo a series of electrophotographic processes, including charging, exposure, and development processes, in which the drum 4*a* has its outer, photoconductive surface initially charged to a uniform potential, and then exposed to the laser beam L to create an electrostatic latent image thereon, followed by developing the latent image into a visible toner image with toner.

Meanwhile, the media conveyance mechanism picks up an uppermost one of the stacked sheets S in one of the input trays, selected either automatically or manually by the user, and feeds it into the media conveyance path P. The fed sheet S first reaches between the pair of registration rollers 10, which hold the incoming sheet S therebetween, and then advance it in sync with the movement of the photoconductive drum 4*a* toward the transfer device 5, at which the developed toner image is transferred from the photoconductive surface to the recording sheet S.

After transfer, the recording sheet S is introduced into the fixing device 7, which fixes the toner image in place on the incoming sheet S with heat and pressure. Upon exiting the fixing device 7, the recording sheet S is directed outside the apparatus body for user pickup, which completes one operational cycle of the image forming apparatus 1.

Figure 2:
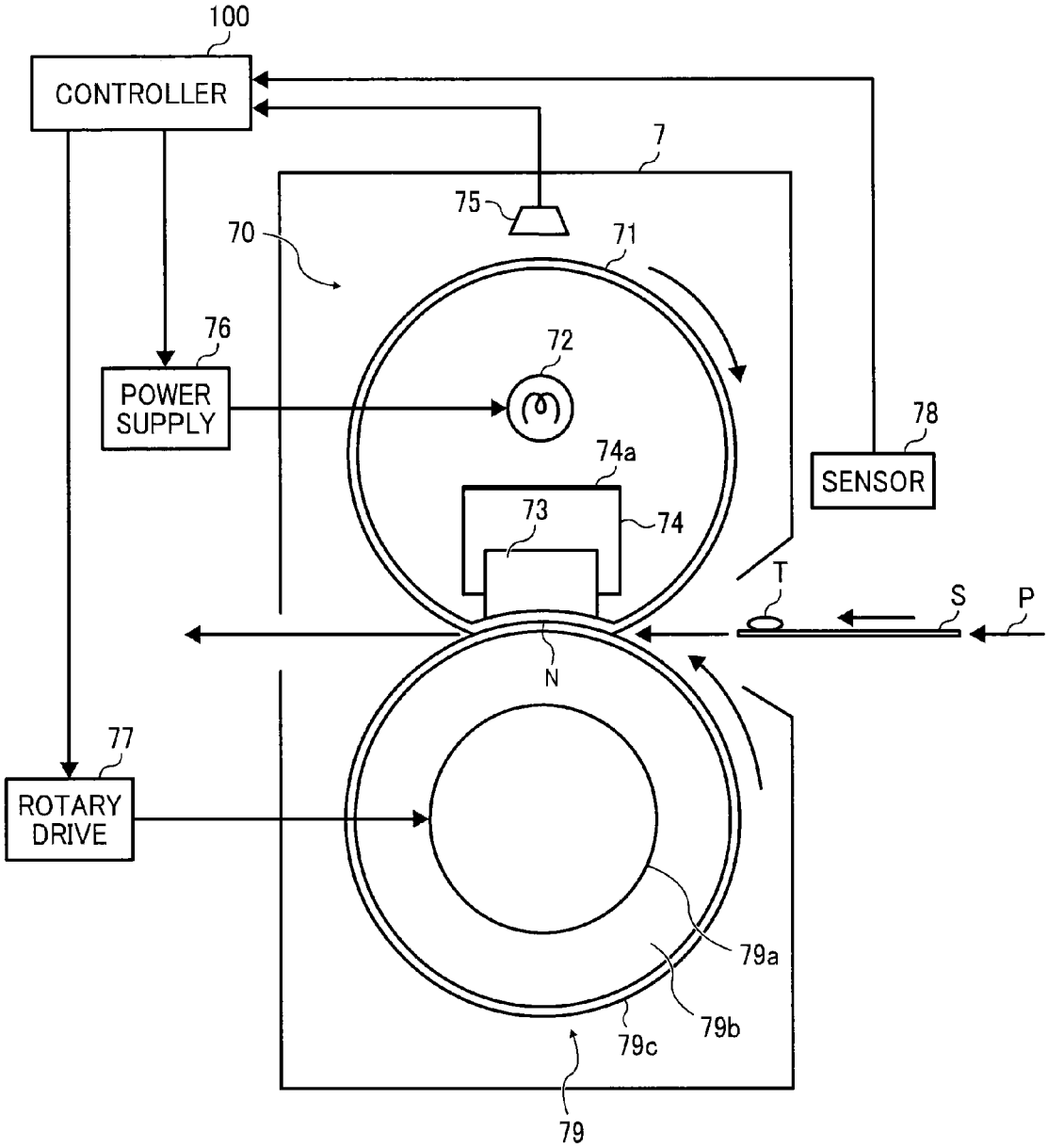
FIG. 2 is an end-on, axial cutaway view of the fixing device according to one or more embodiments of this patent specification.

FIG. 2 is an end-on, axial cutaway view of the fixing device 7 according to one or more embodiments of this patent specification.

As shown in FIG. 2, the fixing device 7 includes a belt-based fuser assembly 70 formed of a rotary, endless fuser belt 71 subjected to heating, on which a recording medium S is conveyed to fuse a toner image T thereon; a heater 72 adjacent to the fuser belt 71 for heating the belt 71; a stationary fuser pad 73 inside the loop of the fuser belt 71; and a reinforcing member 74 for reinforcing the fuser pad 73. A rotary pressure member or roller 79 is disposed opposite the fuser assembly 70 to press against the fuser pad 73 via the fuser belt 71 to form a fixing nip N therebetween, through which a recording sheet S is conveyed under heat and pressure as the belt 71 and the roller 79 rotate together.

Also included in the fixing device 7 are a thermometer 75 adjacent to the fuser belt 71 to detect an operational temperature of the belt 71; a power supply circuit 76 for supplying power to the heater 72; a rotary drive motor 77 for imparting a rotational force or torque to the pressure roller 79; and a media sensor 78 disposed adjacent to the sheet conveyance path P to detect a recording sheet S passing through the fixing device 7.

During operation, upon activation of the image forming apparatus 1, the rotary drive motor 79 drives the pressure roller 79 to rotate counterclockwise in the drawing, which in turn rotates the fuser belt 71 clockwise in the drawing. Meanwhile, the power supply circuit 76 activates the heater 72 to internally heat the fuser belt 71. Power supply to the heater 72 may be computer-controlled (e.g., through on/off control) according to readings of the thermometer 75 detecting a temperature at an outer circumferential surface of the fuser belt 71, so as to maintain the belt temperature within a desired, setpoint temperature range.

Then, a recording sheet S bearing an unfixed, powder toner image T, formed through the electrophotographic imaging processes as described above, enters the fixing device 7 along the sheet conveyance path P. As the fuser belt 71 and the pressure roller 79 rotate together, the recording sheet S enters the fixing nip N, with its front, printed face brought into contact with the fuser belt 71 and bottom face into contact with the pressure roller 79.

At the fixing nip N, the fuser belt 71 heats the incoming sheet S to fuse and melt the toner particles, while the pressure roller 79 presses the sheet S against the fuser pad 73 to fix the molten toner onto the sheet surface. After fixing, the recording sheet S exits the fixing nip N for further conveyance to a subsequent destination along the sheet conveyance path P.

Thus, the fixing device 7 employs the endless fuser belt 71 subjected to heating for fusing a toner image on a recording medium. Using the belt-based fuser assembly 70 allows for an extremely short warm-up time required to heat the fuser member to the setpoint temperature upon activation, owing to relatively small heat capacity of the endless belt 71, compared to that of a cylindrical roller or rotary body of greater thermal mass.

In the present embodiment, the fuser belt 71 comprises a belt of thin, flexible material looped into a generally cylindrical configuration for rotation in a circumferential, rotational direction. In its looped, generally cylindrical configuration, the fuser belt 71 may, for example, have an outer diameter of approximately 30 mm.

Figure 3:
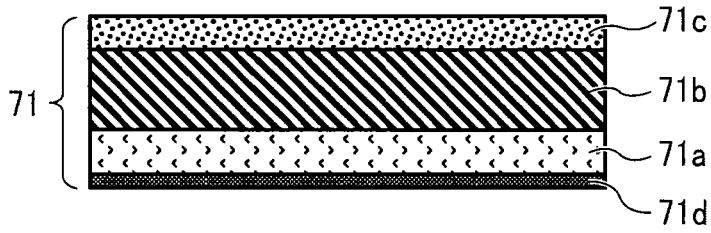
FIG. 3 is an enlarged, partial cross-sectional view of a fuser belt included in the fixing device of FIG. 2.

With additional reference to FIG. 3, which is an enlarged, partial cross-sectional view of the fuser belt 71, the fuser belt 71 is shown consisting of a substrate 71*a*, upon which an intermediate layer 71*b* and an outer coating 71*c* are deposited one upon another to form a multilayered structure, approximately 1 mm or less in thickness. The substrate 71*a* faces an interior of the loop, and the outer coating 71*c* faces an exterior of the loop.

More specifically, the substrate 71*a* of the belt 71 may be formed of metal, such as nickel, stainless steel, or the like, approximately 30 μm to approximately 50 μm thick. The intermediate layer 71*b* of the belt 71 may be formed of rubber, such as solid or foamed silicone rubber, fluorine resin, or the like, approximately 100 μm to approximately 300 μm thick on the substrate 71*a*. The outer coating 71*c* of the belt 71 may be formed of a release agent, such as tetra fluoro ethylene-perfluoro alkylvinyl ether copolymer or PFA, polyimide (PI), polyetherimide (PEI), polyethersulfide (PES), or the like, approximately 10 μm to approximately 50 μm thick on the intermediate layer 71*b*.

The intermediate elastic layer 71*b* serves to accommodate minute variations in applied pressure to maintain a smooth belt surface at the fixing nip N, which ensures uniform distribution of heat across a recording sheet S to yield a resulting image with a smooth, consistent appearance. The release coating layer 71*c* provides good stripping of toner from the belt surface to ensure reliable conveyance of recording sheets S through the fixing nip N.

With continued reference to FIG. 3, the fuser belt 71 in the present embodiment is shown with a black coating layer 71*d* provided on the substrate 71*a* opposite the intermediate layer 71*b* for promoting absorption of electromagnetic radiation, in particular, infrared radiation from the heater 72. The black coating layer 71*d* may be formed through plating of black nickel or black chromium, deposition of black, oxidized material, or oxidization of the surface of the metal substrate 71*a*. Provision of the black coating layer 71*d* enables the belt 71 to effectively absorb electromagnetic or infrared waves emitted from the heater 72 disposed inside the loop of the belt 71, leading to more efficient and accelerated radiant heating of the belt 71, resulting in even shorter warm-up and first-print times of the fixing device.

The heater 72 comprises an elongated, stationary infrared radiant heating element, such as a halogen heater, disposed inside the loop of the fuser belt 71 to generate radiant heat in the fuser belt 71 by emitting electromagnetic radiation when supplied with power from the power supply circuit 76. Although a single elongated halogen lamp is used in the present embodiment, alternatively, instead, the fuser assembly 70 may have multiple heating elements arranged in an axial, longitudinal direction of the fuser assembly 70, which can accommodate different sizes of recording sheets S sequentially processed through the fixing device 7.

The fuser pad 73 comprises a stationary elongated piece extending inside the loop of the fuser belt 71, defining a contact surface on one side thereof to contact the pressure roller 79 via the fuser belt 71 at the fixing nip N. For preventing abrasion of the fuser belt 71 due to sliding against the fuser pad 73, the contact surface of the fuser pad 73 is preferably formed of anti-friction material with a sufficiently low coefficient of friction.

The reinforcing member 74 comprises a stationary elongated piece of rigid material, accommodated inside the loop of the fuser belt 71, having a width extending parallel to a load direction in which the pressure roller 79 exerts pressure against the fuser pad 73. The reinforcing member 74 serves to support pressure from the pressure roller 79 through the fuser pad 73 and the fuser belt 71, so as to prevent the fuser pad 73 from significant deformation under pressure at the fixing nip N. For effective reinforcement of the fuser pad 73, the reinforcing member 74 may be formed of sufficiently rigid material, such as iron, stainless steel, or the like. Also, the width of the reinforcing member 74 is dimensioned sufficiently large to yield a sufficiently large section modulus and mechanical strength against bending or deformation in the load direction.

Optionally, a plate or membrane of reflective material 74*a*, such as aluminum, may be provided on a surface of the reinforcing member 74 facing the heater 72, which is highly reflective to electromagnetic radiation, in particular, infrared radiation from the heater 72. Provision of the reflective surface 74*a* promotes thermal efficiency in radiant heating the fuser belt 71, in that any radiation emitted toward the reinforcing member 74 is reflected off the reflective surface 74*a* to reach the fuser belt 71.

The thermometer 75 comprises a non-contact temperature sensor or thermistor that can detect the belt operational temperature without contacting the belt 71. The thermometer 75 is disposed opposite the heater 72 via the belt 71, that is, in a position that is adjacent or closest to the heater 72 outside and apart from the loop of the fuser belt 71. Instead of a non-contact temperature sensor which is used in the present embodiment, alternatively, the thermometer 75 may be configured as a contact sensor disposed in contact with the fuser belt 71. Although either type of thermometer will work for the intended purpose, a non-contact sensor is superior in terms of immunity against contamination with offset toner and deposits of foreign matter, which would otherwise transfer to a recording medium to smudge the resulting print, as is often the case with a fuser assembly using a contact sensor.

The pressure roller 79 comprises a motor-driven, elastically biased cylindrical body formed of a hollowed core 79*a* of metal, covered with an elastic layer 79*b* of elastic material, such as sponged or solid silicone rubber, fluorine rubber, or the like, equipped with the rotary drive motor 77 that drives the roller 79 to rotate in its rotational direction. An additional, thin outer layer of a release agent 79*c*, such as PFA, PTFE, or the like, may be deposited upon the elastic layer 79*b*. In the present embodiment, the pressure roller 79 is approximately 30 mm in diameter, which equals the diameter of the fuser belt 71 in its looped, generally cylindrical configuration.

With continued reference to FIG. 2, the fixing device 7 is shown further including a controller 100 operatively connected to the thermometer 75 and the media detector 78, as well as to the heater 72 via the power supply circuit 76, and to the pressure roller 79 via the rotary drive motor 77, which controls power supply to the heater 72 and rotary drive of the pressure roller 79 according to readings of the thermometer 75 as well as those of other sensing equipment.

In the present embodiment, the controller 100 comprises control circuitry of the image forming apparatus 1, including a central processing unit (CPU) and its associated memory devices, such as a read-only memory (ROM) for storing operational programs and various types of data for execution of the programs, and a random-access memory (RAM) for storing necessary data for image formation in a form accessible by the CPU.

Figure 4:
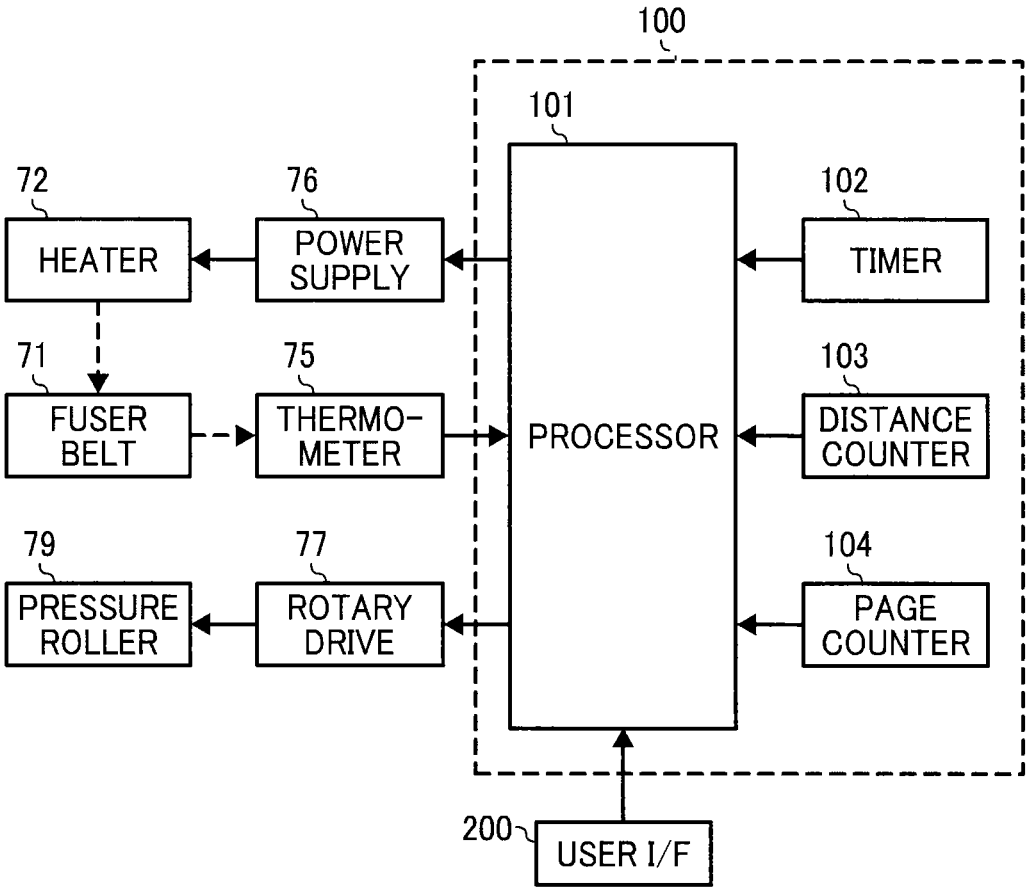
FIG. 4 is a block diagram showing a controller in connection with associated components of the fixing device of FIG. 2.

FIG. 4 is a block diagram showing the controller 100 in connection with associated components of the fixing device 7.

As shown in FIG. 4, the controller 100 includes a processor 101 operatively connected with the power supply circuit 76 of the heater 72, the rotary drive motor 77 of the pressure roller 79, and the thermometer 75 detecting an operational temperature of the fuser belt 71, as well as a user operating unit or interface 200, such as a control panel provided on the apparatus body or a personal computer communicating user-input information via a network, which allows a user to submit a print request to the controller 100.

In the controller 100, the processor 101 executes operational programs that control operation of the fixing device 7, including power supply control of the heater 72 and rotary drive control of the pressure roller 79, according to readings of the thermometer 75. The processor 101 is equipped with a timer 102 that counts a period of on-time during which the heater 72 is activated (i.e., supplied with power), which is enabled upon power-on of the heater 72 and reset upon power-off of the heater 72.

In such a configuration, the processor 101 can detect an abnormal condition in which the operational temperature of the fuser belt 71, as detected by the thermometer 75, remains below a setpoint temperature after lapse of a warm-up time limit TL since activation of the heater 72. That is, the processor 101 can detect a possible anomaly of the heating control system, in which the thermometer 75 fails to correctly measure the operational temperature of the fuser belt 71, and/or the heater 72 and its power supply 76 do not function properly to heat the fuser belt 71 to the setpoint temperature. Upon detecting an abnormal condition, the processor 101 deactivates the heater 72, which may be accompanied with suspension of a current print job as well as user notification of printing failure.

The inventor has recognized difficulties associated with anomaly detection in a belt-based fixing device, which arise from aging or other temporal changes in operational conditions of the fuser belt assembly, causing variations in the speed or efficiency with which the heater heats the fuser belt to a desired, setpoint temperature.

Specifically, the heating speed of the fuser belt may decrease over time because of various factors caused by an extended period of use of the fixing device. For example, one such factor is aging of the belt heater, which leads to a natural reduction in heating performance. Another such factor is gradual deposition of foreign matter on the belt heater (e.g., grease or lubricant agent migrating from the belt inner circumferential surface to the heater), which can adversely affect electromagnetic radiation, in particular, where the heater is configured as a radiant, halogen heater.

Still another factor occurs where the fixing device uses a reflector or reflective surface that directs electromagnetic radiation from the heater to the fuser belt for increasing thermal efficiency. As is the case with the belt heater, gradual deposition of foreign matter on the reflector adversely affects electromagnetic reflection, resulting in a concomitant reduction in the radiant heat generated in the fuser belt.

Yet still another factor occurs where the fuser belt is provided with a black coating material on its inner circumferential surface for increasing thermal efficiency. In this case, abrasion on the belt surface due to sliding against an adjoining element, such as a fuser pad, results in thinning of the black coating and smoothening of the belt surface, both of which adversely affect electromagnetic absorption in the fuser belt, resulting in a concomitant reduction in the radiant heat generated in the fuser belt. Such effects of aging of the fuser belt assembly on thermal efficiency in radiant heating are more specifically described below with reference to FIG. 5.

Figure 5:
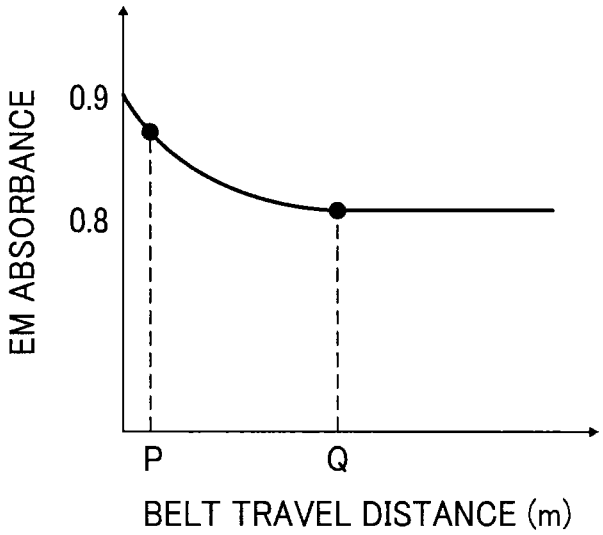
FIG. 5 is a graph showing electromagnetic absorbance of a fuser belt, expressed as a ratio relative to that of a black body, varying with a distance, in meters, traveled by the fuser belt since installation.

FIG. 5 is a graph showing electromagnetic absorbance of a fuser belt, expressed as a ratio relative to that of a black body, at a specific wavelength corresponding to infrared radiation from a halogen lamp, varying with a distance, in meters, traveled by the fuser belt since installation.

As shown in FIG. 5, the electromagnetic absorbance of the belt gradually decreases as the belt travel distance increases from a time point P, at which the fuser belt assembly is in its unaged, substantially as-installed state with the belt travel distance not exceeding 10,000 meters, to a time point Q at which the fuser belt assembly is in its aged or used state with the belt travel distance exceeding 20,000 meters. The difference in electromagnetic absorbance between the earlier and later time points P and Q is caused by changes in characteristics of the fuser belt over an extended period of use.

Specifically, the fuser belt has a relatively rough inner circumferential surface when newly installed in the fixing device. As the belt assembly ages or is more used, the inner circumferential surface of the belt abrades by sliding against the fuser pad inside the belt loop, which gradually wears and smoothes the belt surface. Since a smooth surface generally exhibits a smaller electromagnetic absorbance than that of a rough, irregular surface, such abrasion of the belt surface makes the belt less absorptive to electromagnetic radiation at the later time point Q than at the earlier time point P.

Also, the fuser belt assembly in its unaged state has a coating of electromagnetic absorbing material facing the interior of the looped belt to promote electromagnetic absorption of the belt. Naturally, abrasion over an extended period of use of the belt assembly not only smoothes the belt surface but also thins off the black coating layer, resulting in a smaller electromagnetic absorbance of the belt at the later time point Q than at the earlier time point P.

Thus, smoothening of the belt inner circumferential surface combined with thinning of the black coating layer contribute to a reduction in electromagnetic absorbance of the fuser belt over an extended period of use. In the present case, the electromagnetic absorbance of the belt is slightly below 0.9 at the earlier time point P, and gradually decreases to reach a constant level of approximately 0.8 at the later time point Q.

Reduced thermal efficiency and decelerated heating of the fuser belt translates into a prolonged period of time required for the belt temperature to reach a setpoint temperature upon activation of the heater. Accordingly, as the fuser belt assembly ages or is more used, a warm-up time limit for anomaly detection, designed to work with the fixing device in its new, unaged state, becomes less effective, since it prematurely expires before the belt temperature reaches the setpoint even where the heating control system is properly operating. If not corrected, premature expiration of the warm-up time limit causes the anomaly detector to mistakenly detect an abnormal condition that actually does not exist.

To counteract these and other problems encountered by anomaly detection in a belt-based fixing process, the controller 100 according to this patent specification is configured to adjust the warm-up time limit for anomaly detection according to historical usage data of the fixing device 7 recorded since installation of the fuser belt assembly 70.

Specifically, with continued reference to FIG. 4, the controller 100 is shown further including a historical data recorder, such as a distance counter 103 and a page counter 104, each of which is operatively connected with the processor 101 and records historical usage data of the fixing device 7 since installation for retrieval by the processor 101.

More specifically, the distance counter 103 records a total distance that the fuser belt 71 has traveled since installation, which may be obtained as a cumulative period of time during which the pressure roller 79 rotates multiplied by a rotational speed of the pressure roller 79. The page counter 104 records a total number of recording media that the fixing device 7 has processed since installation, which may be measured, for example, using the media sensor 78 detecting passage of recording sheets S along the sheet conveyance path P.

As used herein, the term "historical usage data" refers to any type of information, either directly measured or derived from other pieces of information, indicative of an age or previous usage of the fuser belt assembly since it is installed as the fixing device. Also, the term "historical data recorder" herein refers to any suitable device or mechanism that can measure, monitor, and/or record historical usage data of the fixing device, the configuration of which may be other than those specifically described in FIG. 4. For example, instead of the distance counter 103 and the page counter 104, the historical data recorder may be configured as a rotation counter that records a total number of rotations that the pressure member has made since installation, or an operational time counter that records a total period of time the fixing device has operated since installation.

During operation, upon receiving a print request submitted by a user, the processor 101 accesses the historical data recorder to adjust the warm-up time limit according to the historical usage data recorded, and subsequently activates the heater 72 to start anomaly detection using the warm-up time limit being adjusted. Adjustment of the warm-up time limit may be accomplished by referring to a lookup table stored in a suitable memory device accessible by the processor 101 in the control circuitry, which associates specific ranges or values of the historical usage data with prescribed, optimal values of the warm-up time limit. An example of such data table is shown in Table 1 below, in which the total travel distance of the fuser belt 71 is associated with an optimized warm-up time limit.

TABLE 1

| Cumulative travel distance (m) | Warm-up time limit (sec) |
|---|---|
| ~10,000 | 30 |
| 10,001~20,000 | 35 |
| 20,001~ | 40 |

Figure 6:
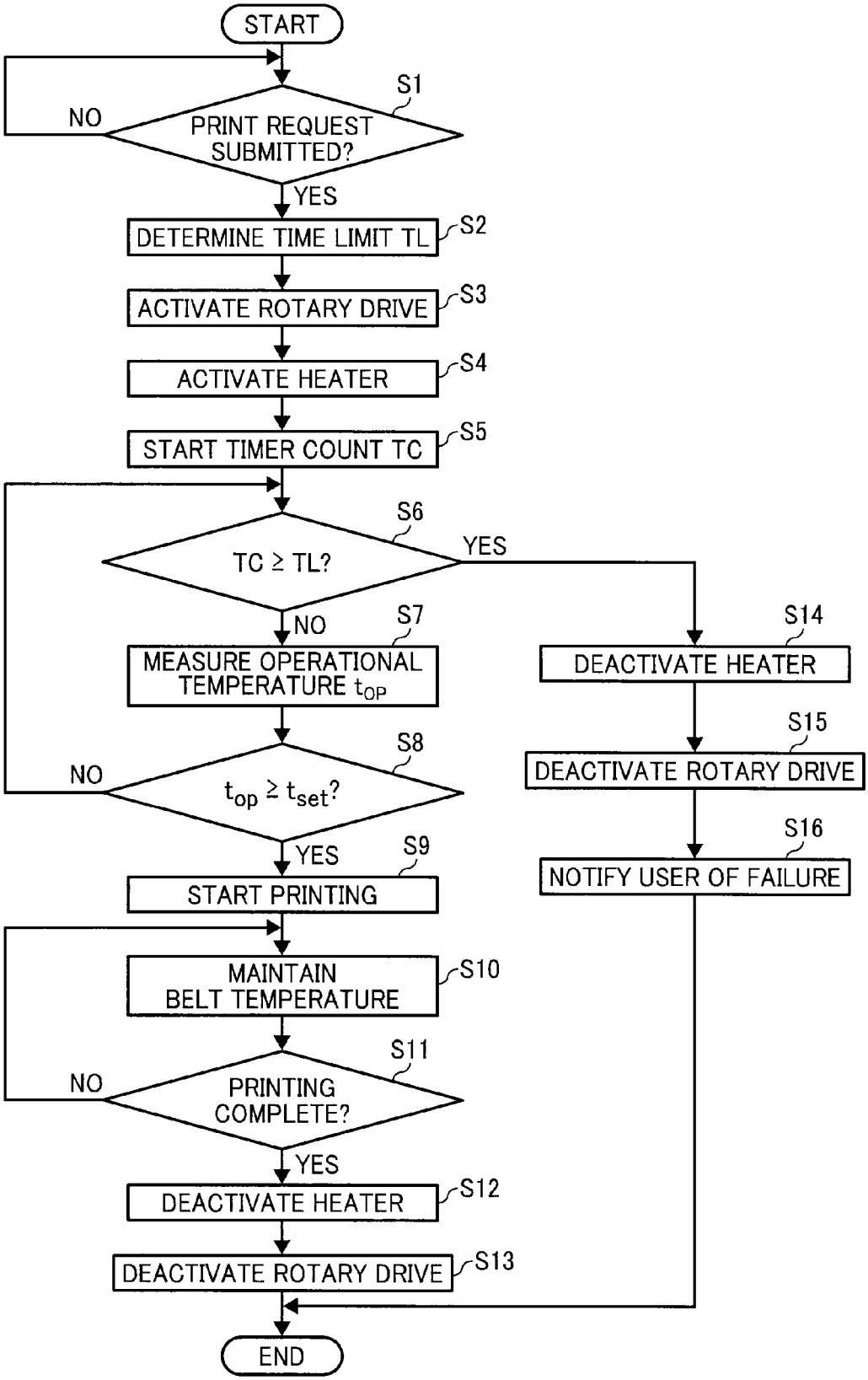
FIG. 6 is a flowchart illustrating an operation of the controller performing anomaly detection using an adjustable warm-up time limit in the fixing device of FIG. 2.

FIG. 6 is a flowchart illustrating an operation of the controller 100 performing anomaly detection using an adjustable warm-up time limit in the fixing device 7.

As shown in FIG. 6, the processor 101 initially waits for user-submission of a print request through the user interface 200 (step S1).

Upon receiving a print request ("YES" in step S1), the processor 101 accesses the distance counter 103 to retrieve a total travel distance of the fuser belt 71 as historical usage data of the fixing device 7, so as to determine, according to the recorded travel distance, a warm-up time limit TL to be used for anomaly detection in the fixing device 7 (step S2).

After determination of the warm-up time limit TL, the processor 101 then activates the rotary drive motor 77 to rotate the pressure roller 79 (step S3), followed by turning on the power supply circuit 76 to activate the heater 72 (step S4), while enabling the timer 102 to start counting a heater on-time TC in response to activation of the heater 72 (step S5), which is subsequently compared against the warm-up time limit TL (step S6).

As long as the on-time count TC does not reach the warm-up time limit TL ("NO" in step S6), the processor 101 causes the thermometer 76 to periodically measure an operational temperature $t_{op}$ of the fuser belt 71 (step S7), which is subsequently compared against a setpoint temperature $t_{set}$ (step S8). Such periodic measurement of the operational temperature $t_{op}$ and subsequent comparison with the setpoint temperature $t_{set}$ may be repeated at an interval of, for example, 500 msec.

Where the operational temperature $t_{op}$ reaches the setpoint temperature $t_{set}$ before the warm-up time limit TL expires ("YES" in step S8), the controller 100 directs the image forming apparatus 1 to start printing according to the print request being submitted (step S9). Otherwise, the operation returns to step S6 to determine whether the warm-up time limit TL has expired before the setpoint temperature $t_{set}$ is reached.

During execution of a print job, the processor 101 controls the power supply circuit 76 to maintain the operational temperature $t_{op}$ within an adequate range around the setpoint temperature $t_{set}$ (step S10). Power supply control of the heater 72 may be performed through, for example, on-off control based on a suitable temperature threshold, in which the power supply circuit 76 turns off where the temperature $t_{op}$ exceeds the threshold temperature and turns on where the temperature $t_{op}$ equals or falls below the threshold temperature. Alternatively, instead, other control algorithm may also be used to control operation of the heater 72.

Meanwhile, the processor 101 monitors the status of the current print job to determine whether it is completed or not (step S11). Where printing is complete ("YES" in step S11), the processor 101 turns off the power supply circuit 76 to deactivate the heater 72 (step S12), followed by deactivating the rotary drive motor 77 to stop rotation of the pressure roller 79 (step S13), upon which the operation terminates.

Where the on-time count TC reaches the warm-up time limit TL before the setpoint temperature $t_{set}$ is reached ("YES" in step S6), the processor 101 determines that the heating control system is in an abnormal condition, and then executes a routine procedure for handling anomalies, including, for example, turning off the power supply circuit 76 to deactivate the heater 72 (step S14), deactivating the rotary drive motor 77 to stop rotation of the pressure roller 79 (step S15), and notifying the user of printing failure, for example, by displaying an error message on the user interface (step S16), upon which the operation terminates.

Figure 7:
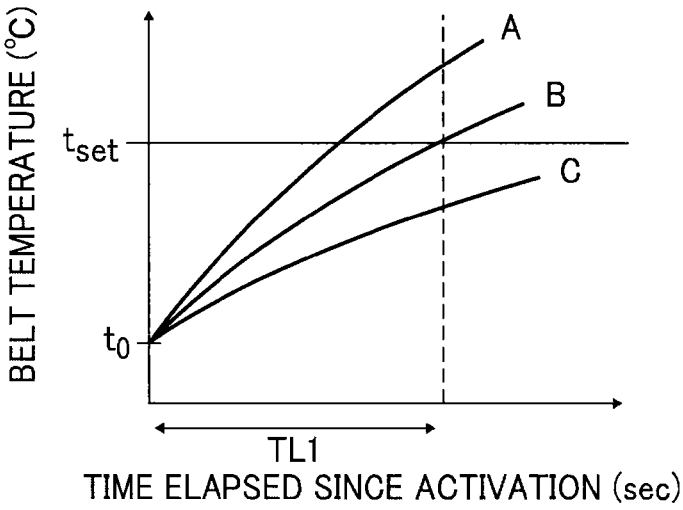
FIG. 7 shows graphs of the belt operational temperature, in degrees Celsius, varying with time, in seconds, after activation of a heater, as detected by a thermometer under different operational conditions of the fixing device in its unaged state.
Figure 8:
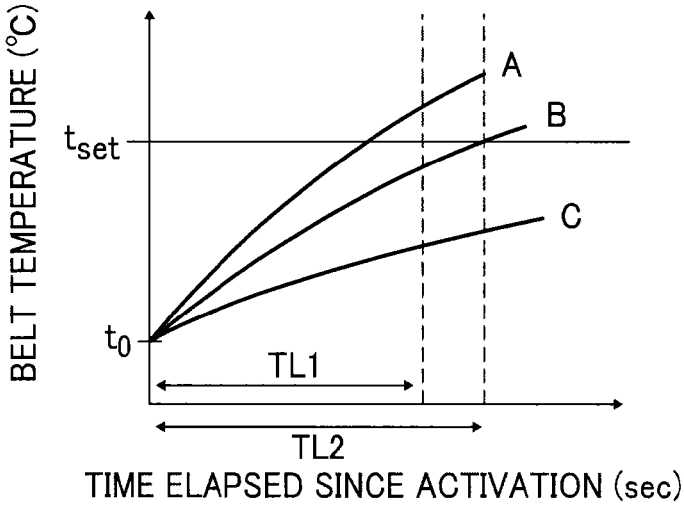
FIG. 8 shows graphs of the belt operational temperature, in degrees Celsius, varying with time, in seconds, after activation of a heater, as detected by a thermometer under different operational conditions of the fixing device in its aged state.

FIGS. 7 and 8 show graphs of the belt operational temperature, in degrees Celsius, varying with time, in seconds, after activation of the heater 72, detected by the thermometer 75 under different operational conditions of the fixing device 7 in its unaged and aged states, respectively, wherein curves labeled "A" represent values obtained where the heater 72 is operated with a normal power supply voltage, curves labeled "B" represent values obtained where the heater 72 is operated with a lowest allowable power supply voltage, and curves labeled "C" represent values obtained where the heating control system is in an abnormal condition.

As shown in FIGS. 7 and 8, in general, the belt operational temperature rises at a higher heating speed where the fixing device 7 is in its unaged, substantially as-installed state (FIG. 7) than where the fixing device 7 is in its aged or used state (FIG. 8). The difference in the belt heating speed reflects variations in electromagnetic absorbance of the fuser belt over time, as explained with reference to FIG. 5. That is, in its unaged state, the fuser belt exhibits a relatively high electromagnetic absorbance, which enables the radiant heater to warm up the belt efficiently and swiftly, as shown in FIG. 7, whereas, in its aged state, the fuser belt exhibits a relatively low electromagnetic absorbance, resulting in reduced thermal efficiency and decelerated heating speed of the belt, as shown in FIG. 8.

In the present embodiment, the processor 101 increases the warm-up time limit TL where the historical usage data indicates an increasing age of the fixing device 7.

Specifically, the warm-up time limit TL is initially set to a first value TL1 where the historical usage data indicates that the fuser device 7 is in its unaged state. With specific reference to FIG. 7, the first value TL1 for the warm-up time limit TL represents a period of time required for the operational temperature of the fuser belt 71, as detected by the thermometer 75, to rise from a reference temperature $t_0$ to the setpoint temperature $t_{set}$ where the heater 75 is operated with a lowest allowable power supply voltage in the fixing device 7 in its unaged state, as represented by curve B in FIG. 7.

Also, the warm-up time limit TL is changed from the first value TL1 to a second value TL2 where the historical usage data indicates that the fuser device 7 is in its aged state. With specific reference to FIG. 8, the second value TL2 for the warm-up time limit TL represents a period of time required for the operational temperature of the fuser belt 72, as detected by the thermometer 75, to rise from a reference temperature $t_0$ to the setpoint temperature $t_{set}$ where the heater 75 is operated with a lowest allowable power supply voltage in the fixing device 7 in its aged state, as represented by curve B in FIG. 8.

The specific values of warm-up time limits TL1 and TL2 may vary depending on specific configurations of the fixing device 7. For example, in the present embodiment, the unaged state of the fixing device 7 is indicated where the belt travel distance recorded by the distance counter 103 does not exceed 10,000 meters, and the aged state of the fixing device 7 is indicated where the belt travel distance recorded by the distance counter 103 exceeds 20,000 meters. In this case, with the reference temperature $t_0$ defined as 0° C., the setpoint temperature $t_{set}$ as 140° C., and the lowest allowable power supply voltage as 90 V, the first warm-up time limit TL1 is set at 30 seconds, and the second warm-up time limit TL2 is set at 40 seconds.

Note that setting the warm-up time limit TL to the specific values TL1 or TL2 depending on the aging state of the fixing device 7 allows for correct detection of an abnormal condition based on the operational temperature of the fuser belt 71 as detected by the thermometer 75.

Specifically, as shown in FIG. 7, the first warm-up time limit TL1 does not expire before the belt temperature rises from the reference temperature $t_0$ to the setpoint temperature $t_{set}$ insofar as the fixing device 7 properly operates where the heater 72 is operated with the normal power supply voltage (as represented by curve A), and where the heater 72 is operated with the lowest allowable power supply voltage (as represented by curve B). The first warm-up time limit TL1 is reached only where the heating control system is in an abnormal condition (as represented by curve C), causing the controller 100 to determine that there is an abnormal condition in the heating control system.

Also, as shown in FIG. 8, the second warm-up time limit TL2 does not expire before the belt temperature rises from the reference temperature $t_0$ to the setpoint temperature $t_{set}$ insofar as the fixing device 7 properly operates where the heater 72 is operated with the normal power supply voltage (as represented by curve A), and where the heater 72 is operated with the lowest allowable power supply voltage (as represented by curve B). The second warm-up time limit TL2 is reached only where the heating control system is in an abnormal condition (as represented by curve C), causing the controller 100 to determine that there is an abnormal condition in the heating control system.

Consider if the first warm-up time TL1 were used for anomaly detection where the fixing device is in its aged state. As shown in FIG. 8, the first warm-up time limit TL1 expires before the belt temperature rises from the reference temperature $t_0$ to the setpoint temperature $t_{set}$ where the heater 72 is operated with the lowest allowable power supply voltage (as represented by curve B), causing the controller to mistakenly detect an abnormal condition that actually does not exist. Thus, using the first warm-up time limit TL1 after aging of the fixing device would result in faulty detection of an abnormal condition, which can be avoided by using the second warm-up time limit TL2 where the historical usage data indicates that the fuser device is in its aged state.

Thus, the fixing device 7 can adjust the warm-up time limit TL to an optimal, minimal effective value depending on the historical usage data indicative of an increasing age of the fixing device 7. Such optimization of the warm-up time limit TL allows for correct and immediate detection of an abnormal condition even where aging of the fixing device 7 causes variations in the warm-up time required for the belt temperature as detected by the thermometer to reach a desired setpoint temperature upon activation.

To recapitulate, the fixing device 7 according to this patent specification includes a rotary, endless fuser belt 71 subjected to heating, on which a recording medium S is conveyed to fuse a toner image thereon; a heater 72 adjacent to the fuser belt 71 for heating the belt 71; a thermometer 75 adjacent to the fuser belt 71 to detect an operational temperature of the belt 71; and a controller 100 operatively connected to the thermometer 75 and the heater 72 to deactivate the heater 72 upon detecting an abnormal condition in which the operational temperature $t_{op}$ detected remains below a setpoint temperature $t_{set}$ after lapse of a warm-up time limit TL since activation of the heater 72. The controller 100 includes a historical data recorder, such as a distance counter 103 or a page counter 104, to record historical usage data of the fixing device 7 since installation, and a processor 101 to adjust the warm-up time limit TL according to the historical usage data recorded by the historical data recorder.

Provision of the controller 100 enables the fixing device 7 to adjust the warm-up time limit TL to an optimal, minimal effective value depending on the historical usage data indicative of an increasing age of the fixing device 7. Such optimization of the warm-up time limit TL allows for correct and immediate detection of an abnormal condition even where aging of the fixing device 7 causes variations in the warm-up time required for the belt temperature as detected by the thermometer to reach a desired setpoint temperature upon activation.

The historical data recorder of the controller 100 may be configured as a distance counter 103 that records a total distance that the fuser belt 71 has traveled since installation. Using the belt travel distance, which directly reflects age or previous usage of the fixing device 7 since installation, allows for accurate optimization of the warm-up time limit TL based on the historical usage data.

The fixing device may have a rotary pressure member 79 pressing against the fuser belt 71 to form a fixing nip N therebetween, through which a recording medium S is conveyed under heat and pressure as the belt 71 and the pressure member 79 rotate together. In such cases, the historical data recorder may be configured as a rotation counter that records a total number of rotations that the pressure member 79 has made since installation. Using the rotation count recorded by the rotation counter, which is highly correlated with the belt travel distance indicative of age or previous usage of the fixing device 7 since installation, allows for accurate optimization of the warm-up time limit TL based on the historical usage data, as is the case with embodiments using the distance counter.

The historical data recorder may also be configured as a page counter 104 that records a total number of recording media that the fixing device has processed since installation, or an operational time counter that records a total period of time the fixing device has operated since installation. In either case, adjusting the warm-up time limit TL according to the counter record, which is highly correlated with the belt travel distance indicative of age or previous usage of the fixing device 7 since installation, allows for accurate optimization of the warm-up time limit based on the historical usage data, as is the case with embodiments using the distance counter or the rotation counter.

The processor 101 may be configured to increase the warm-up time limit TL where the historical usage data indicates an increasing age of the fixing device 7. Such arrangement provides effective optimization of the warm-up time limit TL where the heating speed of the fuser belt 71 gradually decreases with aging of the fixing device 7.

Alternatively, instead, the processor 101 may be configured to decrease the warm-up time limit TL where the historical usage data indicates an increasing age of the fixing device 7. Such arrangement provides effective optimization of the warm-up time limit TL where the heating speed of the fuser belt 71 gradually increases with aging of the fixing device 7, for example, due to a gradual loss of lubricant, such as grease or oil, applied to the fuser belt which can reduce heat capacity of the fuser belt assembly.

The heater 72 for heating the belt 71 may be configured as a radiant, halogen heater that emits an electromagnetic wave to induce radiant heat in the belt. Using a halogen heater, as opposed to a special or complicated heat source, allows for a simple and cost-effective configuration of the fixing device 7.

The fuser belt 71 may have a coating of electromagnetic absorbing material on a circumferential surface facing the heater 72. Provision of the coating of electromagnetic absorbing material increases thermal efficiency in radiant-heating the belt 71, which allows for shorter warm-up and first-print times of the fixing device 7. Optimization of the warm-up time limit TL based on historical usage data effectively compensates for possible variations in the heating speed of the fuser belt 71 due to abrasion of the inner circumferential surface of the belt causing a gradual loss of electromagnetic absorbance and a concomitant reduction in the belt heating speed.

The thermometer 75 for detecting an operational temperature of the belt 71 may be configured as a non-contact sensor that measures the belt operational temperature without contacting the belt, or alternatively, a contact sensor that measures the belt operational temperature in contact with the belt. Although either will work for the intended purpose, a non-contact sensor is superior in terms of immunity against contamination with offset toner and deposits of foreign matter, which would otherwise transfer to a recording medium to smudge the resulting print, as is often the case with a fuser assembly using a contact sensor.

Although in several embodiments described herein, the capability of the fixing device 7 to adjust the warm-up time limit TL is associated with a reduction in the heating speed of the fuser belt 71 caused by smoothing of the belt surface and thinning of the black coating layer, optimization of the warm-up time limit TL according to this patent specification is also applicable where the heating speed of the fuser belt 71 is affected by other factors over an extended period of use of the fixing device.

For example, the heating speed of the fuser belt may decrease where the reflective surface or the reflector attached to the reinforcement member deteriorates over time or becomes soiled with foreign matter, causing a reduction in electromagnetic radiation reflection by the reinforcement member, leading to a concomitant reduction in radiant heat generated in the fuser belt. Also, the heating speed of the fuser belt may decrease where the radiant heater, or halogen lamp, deteriorates or has its glass tube covered with grease or lubricating agent migrating from the inner circumferential surface of the fuser belt. In either case, adjusting the warm-up time limit TL according to historical usage data works to provide correct and immediate anomaly detection in the belt-based fixing device 7.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device for fixing a toner image in place on a recording medium, the fixing device comprising:

a rotary, endless fuser belt subjected to heating, on which the recording medium is conveyed to fuse the toner image thereon;

a heater for heating the fuser belt;

a thermometer to detect an operational temperature of the fuser belt; and a controller operatively connected to the thermometer and the heater to deactivate the heater upon detecting an abnormal condition in which the operational temperature detected remains below a setpoint temperature after lapse of a warm-up time limit since activation of the heater, the controller including:

a historical data recorder to record historical usage data of the fixing device since installation, and a processor to adjust the warm-up time limit according to the historical usage data recorded by the historical data recorder, wherein the warm-up time limit is initially set to a first value where the historical usage data indicates that the fixing device is in an unaged state, the first value representing a period of time required for the operational temperature of the fuser belt, as detected by the thermometer, to rise from a reference temperature to the setpoint temperature where the heater is operated with a lowest allowable power supply voltage in the fixing device in the unaged state.

2. The fixing device according to claim 1, wherein the historical data recorder comprises a distance counter that records a total distance that the fuser belt has traveled since installation.

3. The fixing device according to claim 1, further comprising:

a rotary pressure member pressing against the fuser belt to form a fixing nip therebetween, through which the recording medium is conveyed under heat and pressure as the belt and the pressure member rotate together, wherein the historical data recorder includes a rotation counter that records a total number of rotations that the pressure member has made since installation.

4. The fixing device according to claim 1, wherein the historical data recorder comprises a page counter that records a total number of recording media that the fixing device has processed since installation.

5. The fixing device according to claim 1, wherein the historical data recorder comprises a time counter that records a total period of time the fixing device has operated since installation.

6. The fixing device according to claim 1, wherein the processor increases the warm-up time limit where the historical usage data indicates an increasing age of the fixing device.

7. The fixing device according to claim 1, wherein the processor decreases the warm-up time limit where the historical usage data indicates an increasing age of the fixing device.

8. The fixing device according to claim 1, wherein the warm-up time limit is changed from the first value to a second value where the historical usage data indicates that the fuser device is in the aged state, the second value representing a period of time required for the operational temperature of the fuser belt, as detected by the thermometer, to rise from the reference temperature to the setpoint temperature where the heater is operated with a lowest allowable power supply voltage in the fixing device in the aged state.

9. The fixing device according to claim 1, wherein the processor adjusts the warm-up time limit by referring to a lookup table which associates specific ranges or values of the historical usage data with prescribed, optimal values of the warm-up time limit.

10. The fixing device according to claim 1, wherein the fuser belt has a coating of electromagnetic absorbing material on a circumferential surface facing the heater.

11. The fixing device according to claim 1, wherein the heater comprises a radiant heater that emits an electromagnetic wave to induce radiant heat in the fuser belt.

12. The fixing device according to claim 1, wherein the heater comprises a halogen heater.

13. The fixing device according to claim 1, wherein the thermometer comprises a non-contact sensor that measures the belt operational temperature without contacting the belt.

14. The fixing device according to claim 1, wherein the controller suspends a current print job and notifies a user of printing failure upon detecting an abnormal condition.

15. A heater control method for use in a fixing device that employs a heater to heat a rotary, endless belt, the method comprising:

activating the heater;

detecting an operational temperature of the belt;

adjusting a warm-up time limit according to historical usage data of the fixing device recorded since installation; and deactivating the heater where the operational temperature detected remains below a setpoint temperature after lapse of the warm-up time limit since activation of the heater, wherein the warm-up time limit is initially set to a first value where the historical usage data indicates that the fixing device is in an unaged state, the first value representing a period of time required for the operational temperature of the fuser belt to rise from a reference temperature to the setpoint temperature where the heater is operated with a lowest allowable power supply voltage in the fixing device in the unaged state.

16. An image forming apparatus, comprising:

an imaging unit to form a toner image on a recording medium; and a fixing device to fix the toner image in place on the recording medium, the fixing device comprising:

a rotary, endless fuser belt subjected to heating, on which the recording medium is conveyed to fuse the toner image thereon;

a heater for heating the belt;

a thermometer to detect an operational temperature of the belt;

means for deactivating the heater where the operational temperature detected remains below a setpoint temperature after lapse of a warm-up time limit since activation of the heater; and means for adjusting the warm-up time limit according to historical usage data of the fixing device recorded since installation, wherein the warm-up time limit is initially set to a first value where the historical usage data indicates that the fixing device is in an unaged state, the first value representing a period of time required for the operational temperature of the fuser belt, as detected by the thermometer, to rise from a reference temperature to the setpoint temperature where the heater is operated with a lowest allowable power supply voltage in the fixing device in the unaged state.

17. A method for fixing a toner image on a recording medium in a fixing device, the method comprising:

providing a rotary, endless fuser belt;

conveying the recording medium on the fuser belt to fuse the toner image thereon;

heating the fuser belt;

detecting an operational temperature of the fuser belt; and providing a controller operatively connected to the thermometer and the heater to deactivate the heater upon detecting an abnormal condition in which the operational temperature detected remains below a setpoint temperature after lapse of a warm-up time limit since activation of the heater;

recording, via a historical data recorder, historical usage data of the fixing device since installation;

adjusting the warm-up time limit according to the historical usage data recorded by the historical data recorder, via a processor; and initially setting the warm-up time limit to a first value where the historical usage data indicates that the fixing device is in an unaged state, the first value representing a period of time required for the operational temperature of the fuser belt to rise from a reference temperature to the setpoint temperature where the heater is operated with a lowest allowable power supply voltage in the fixing device in the unaged state.

* * * * *